United States Patent [19]

Maskasky

[11] 4,158,565

[45] Jun. 19, 1979

[54] PROCESSES FOR PRODUCING POSITIVE OR NEGATIVE DYE IMAGES USING HIGH IODIDE SILVER HALIDE EMULSIONS

[75] Inventor: Joe E. Maskasky, Rochester, N.Y.

[73] Assignee: Eastman Kodak Company, Rochester, N.Y.

[21] Appl. No.: 874,600

[22] Filed: Feb. 2, 1978

[51] Int. Cl.[2] ..... G03C 7/00; G03C 5/64

[52] U.S. Cl. ..... 96/29 D; 96/55

[58] Field of Search ..... 96/55, 94 R, 3, 48 R, 96/22, 59, 29 D

[56] References Cited

U.S. PATENT DOCUMENTS

| | | | |
|---|---|---|---|
| 3,674,490 | 7/1972 | Matejec | 96/48 R |
| 3,862,842 | 1/1975 | Bissonette | 96/55 |
| 4,002,477 | 1/1977 | Bissonette | 96/3 |
| 4,089,685 | 5/1978 | Bissonette | 96/59 |
| 4,094,684 | 6/1978 | Maskasky | 96/94 R |

*Primary Examiner*—Won H. Louie, Jr.
*Attorney, Agent, or Firm*—Carl O. Thomas

[57] ABSTRACT

Processes are disclosed for producing dye images employing photographic elements which comprise a support and coated thereon, at least one radiation-sensitive colorforming layer unit. This layer unit includes a substantially uniform distribution of catalyst and a radiationsensitive, high iodide silver halide emulsion. A first method for producing dye images after imagewise exposure of the photographic element comprises the steps of imagewise poisoning the catalyst with iodide ion by developing the silver iodide containing silver halide emulsion and thereafter employing the remaining unpoisoned catalyst to permit a redox reaction between a peroxide oxidizing agent and a dye-image-generating reducing agent. In a preferred element the high iodide silver halide emulsion is comprised of multifaceted, radiation-receptive silver iodide crystals and silver chloride crystals forming epitaxial junctions with the silver iodide crystals. A dye image of opposite sense can be produced using the preferred element by the steps of poisoning the catalyst; selectively developing the silver chloride portion of the silver halide emulsion; and amplifying the resulting silver image using the peroxy redox amplification reaction.

19 Claims, No Drawings

PROCESSES FOR PRODUCING POSITIVE OR NEGATIVE DYE IMAGES USING HIGH IODIDE SILVER HALIDE EMULSIONS

FIELD OF THE INVENTION

The present invention is directed to novel processes for producing photographic dye images. More specifically, the present invention is directed to processes for producing either positive or negative images. These processes use high iodide silver halide emulsions.

BACKGROUND OF THE INVENTION

The formation of reversal dye images in photographic elements is generally old and well known in the photographic arts. In a typical approach, a photographic element capable of forming a multicolor image is imagewise exposed and developed in a black-and-white photographic developer composition. The undeveloped silver halide is next rendered developable by uniform exposure or by nucleation. The remaining silver halide is then developed using a color developing agent so that a positive dye image is formed. Reversal processing has proven quite attractive, since it offers a convenient approach for obtaining a positive dye image using a negative-working silver halide emulsion without the necessity of first producing a negative dye image and then reexposing a second photographic element through the negative dye image. Reversal processing to form positive dye images is widely employed in producing color photographic transparencies.

Commonly assigned, copending application Ser. No. 730,912, filed Oct. 8, 1976, (now U.S. Pat. No. 4,089,685, issued May 16, 1978) of Bissonette discloses a process wherein a peroxide redox amplification catalyst is poisoned by iodide ion. A positive image is produced according to this process in the following manner: A conventional exposed negative-working silver halide element is developed to produce a negative silver image. This negative silver image is poisoned, either during silver halide development or in a subsequent step, by iodide ion. Then, the remaining silver halide is rendered developable. Development of this remaining silver halide results in a positive silver image which can be used to catalyze a peroxide redox amplification reaction.

I disclose in my copending application Ser. No. 770,241, filed Feb. 18, 1977, (now U.S. Pat. No. 4,094,684, issued June 13, 1978) entitled "Photographic Emulsions and Elements" emulsions which contain composite silver iodide crystals and silver chloride crystals joined at epitaxial junctions. By proper selection of development conditions, the silver chloride can be developed in preference to the silver iodide, and the release of iodide ions can thereby be controlled. When the composite crystals are entirely developed, the emulsions can be used to imagewise poison developed silver—that is, the silver formed by development of the silver halide can be poisoned as it is developed by the concurrently released iodide ion. While the use of these emulsions in the process of Bissonette, cited above, provides a method for selectively releasing iodide ion from the emulsion to poison the negative silver image, all of the process steps of Bissonette are still required. That is, the remaining silver halide must first be rendered developable and then developed in order to provide a positive catalytic image.

The formation of positive dye images using a cobalt(III) complex as an oxidizing agent in redox dye image amplification processes is known in the art. Such a process is disclosed in Example 1 of Bissonette U.S. Pat. No. 4,002,477, issued Jan. 11, 1977. In such processes the use of a preformed catalyst is contemplated, with exposure and processing being relied upon to imagewise poison the catalyst in exposed areas. Since the halide ions released by development of exposed silver halide do not effectively poison the preformed catalyst, where a cobalt(III) complex oxidizing agent is employed, it is necessary to incorporate other poison releasing materials. In Example 1 a development inhibitor releasing coupler is employed for this purpose.

SUMMARY OF THE INVENTION

I have found that in a redox dye image-forming process employing a peroxide oxidizing agent the iodide ion that is released by developing a high iodide silver halide emulsion can be used to poison imagewise a substantially uniform distribution of catalyst. The remaining unpoisoned catalyst can be used to catalyze the redox dye image-forming reaction, thereby forming a dye image. Only a single silver halide development step is required, and it is unnecessary to incorporate any material other than the catalyst and the high iodide silver halide into the photographic element being processed in order to obtain a dye image. At the same time, the art recognized advantages of employing peroxide oxidizing agents and dye-image-generating reducing agents to form dye images, such as dye image amplification, reduced silver halide coverages, enhanced photographic speeds and/or contrast, elimination of silver halide fixing and/or silver bleaching, etc., can be achieved. My invention represents an advantage in the art in terms of the simplicity of the photographic process of imaging, considering both the simplicity of the manipulative processing steps and the simplicity of the elements capable of being so processed. Further, my invention is particularly useful in that dye images which are of one sense (positive or negative) or reversed in sense can be obtained readily.

In order to practice my method, I provide an element comprising a support having coated thereon at least one radiation-sensitive color-forming layer unit. This layer unit has a substantially uniform distribution of a catalyst capable of catalyzing a redox reaction between a peroxide developing agent and a dye-image-generating reducing agent and a negative-working radiation-sensitive silver halide containing at least 25 mole percent silver iodide based on the total silver halide. After imagewise exposure of this element, a dye image can be produced by developing the silver halide so as to imagewise release iodide ion, thereby imagewise poisoning the substantially uniform distribution of catalyst and leaving a positive catalytic image, and using the positive catalytic image to catalyze a redox reaction between a peroxide oxidizing agent and a dye-image-generating reducing agent, wherein the oxidizing agent and the reducing agent are chosen so that they are essentially inert to oxidation-reduction in the absence of a catalyst.

In a preferred element, the silver halide containing at least 25 mole percent silver iodide based on total silver halide is comprised of multifaceted, radiation-receptive silver iodide crystals and silver chloride crystals forming epitaxial junctions with the silver iodide crystals.

It is a highly desirable feature of my invention that the same preferred element can be used to form either positive catalyst images, as described above, or negative catalyst images. Using the preferred element described above, the release of iodide ions during negative development can be controlled, and a negative catalyst image can be formed. The substantially uniform distribution of catalyst is uniformly poisoned, the silver chloride is selectively developed so that iodide ion release is avoided, thereby forming a negative catalytic silver image, and the negative catalytic silver image is used to catalyze a redox reaction between a peroxide oxidizing agent and a dye-image-generating reducing agent wherein the oxidizing agent and the reducing agent are chosen so that they are essentially inert to oxidation-reduction in the absence of a catalyst. The dye image produced is opposite in sense to that produced when a positive catalyst image is employed in the redox reaction.

DETAILED DESCRIPTION OF THE INVENTION

Elements which are useful herein are characterized by at least one color-forming layer unit having a substantially uniform distribution of catalyst in reactive association with a negative-working high iodide silver halide emulsion layer coated on a photographic support. By reactive association it is meant that the catalyst is in the same layer as the emulsion and/or in an adjacent layer and/or separated by a layer or layers that are permeable to iodide ion. The term "color-forming layer unit" is therefore intended to encompass any of these configurations and any equivalent configuration. In preferred embodiments, the uniform distribution of catalyst is in the same layer as the high iodide silver halide emulsion.

The substantially uniform distribution of catalyst can be coated on the element in a variety of ways. A dispersion of the catalyst can be included with the coating composition for the silver halide emulsion layer, this being the preferred method. Alternatively, where the catalyst consists of metal nuclei, the nuclei can be vacuum evaporated on the emulsion layer or on the support before the emulsion layer is overcoated to give a uniform distribution. Still another method is to disperse the catalyst in a suitable binder and coat the resulting composition on the silver halide emulsion layer. Yet another method is to coat a layer containing a fogged silver halide emulsion. Other equivalent methods will be readily apparent.

The catalyst can be any material which is capable of catalyzing a redox reaction between a peroxide oxidizing agent and a dye-image-generating reducing agent. A wide variety of materials which meet these criteria are known. Useful materials include, for example, nuclei of carbon and the more catalytically active metals, such as silver, gold and the noble metals of group VIII. Useful catalysts are disclosed by Matejec U.S. Pat. No. 3,674,490, issued July 4, 1972, here incorporated by reference.

A preferred catalyst is silver nuclei. Colloidal silver, such as Carey Lea Silver, or a fogged Lippmann emulsion is particularly preferred. Generally the catalyst need be present in only very small amounts, typically between about 0.1 and about 20 mg/m$^2$. Factors such as the type and activity of the catalyst, the amount of iodide released upon development of the high-iodide silver halide emulsion, acceptable minimum densities and the like, can influence the catalyst concentrations employed.

The high iodide silver halide emulsion which is associated with the substantially uniform distribution of catalyst is selected so that it can be developed to provide sufficient iodide ion to poison the catalyst. The silver iodide can be present in an amount from about 25 mole percent to 100 mole percent based on the total silver halide. The high iodide silver halide emulsion can be present in the color-forming layer unit in conventional coating coverages for silver halide emulsions. Such coverages are disclosed, for example, in U.S. Pat. Nos. 3,674,490 and 4,002,477 U.S. Ser. Nos. 730,912 and 770,241, cited above, and U.S. Ser. No. 770,242, cited below. Generally it is possible to prepare useful photographic elements which can be processed according to the present invention with as little as 1.0 mg/m$^2$ of total silver, including both silver halide and silver catalyst, in each color-forming layer unit.

High iodide silver halide emulsions are known on the art. For example, Steigman German Patent 505,012, issued Aug. 12, 1930, discloses a high iodide silver halide emulsion. High iodide silver halides are also employed in photothermographic compositions and elements, such as disclosed in U.S. Pat. No. 3,785,830, issued Jan. 15, 1974, and U.S. Pat. No. 3,839,860, issued July 8, 1975.

Particularly useful high iodide silver halide emulsions are described in my copending application Ser. No. 770,241, cited above, here incorporated by reference. Silver halide emulsions are described therein containing composite silver halide crystals. The composite crystals are comprised of multifaceted silver iodide crystals forming epitaxial junctions with silver chloride crystals. Such crystals are hereinafter sometimes referred to as composite silver chloride-silver iodide crystals or composite AgCl/AgI crystals. The composite silver chloride-silver iodide crystals are particularly useful in the present invention because they easily release large quantities of iodide ion and because the release of iodide ion can be controlled by processing conditions.

In a preferred form, these composite silver chloride-silver iodide containing emulsions contain multifaceted, radiation-receptive silver iodide crystals having a minimum mean diameter of at least 0.1 micron. Silver chloride crystals form epitaxial junctions with the silver iodide crystals, and at least half of the facets of the silver iodide crystals are substantially free of epitaxial silver chloride. The silver chloride of the composite crystals is limited to less than 75 mole percent, based on the total silver halide forming the composite crystals, so that at least 25 mole percent is silver iodide. The minimum amount of epitaxial silver chloride employed is only that required to assure its distribution among the silver iodide crystals. Generally developable emulsions can be obtained with as little as 1 mole percent silver chloride. I generally prefer that the epitaxial silver chloride grains account for at least 5 mole percent of the composite crystals, since silver chloride has the effect of accelerating initial development rates. The silver chloride crystals forming a part of the composite crystals can be internally metal doped. The composite crystals can be monodispersed or heterodispersed. Preferred features of the composite silver chloride-silver iodide emulsions are more specifically set forth in U.S. Ser. No. 770,241, cited above.

The term "epitaxial" an applied to the composite silver chloride-silver iodide crystals or grains is employed in its accepted usage to mean that the crystallographic orientation of the silver and chloride atoms of the crystals are controlled by the crystalline substrate, the silver iodide crystals, on which they are grown. The epitaxial relationship of the silver chloride and silver iodide portions of the composite crystals is then quite distinct from direct physical contact of separate silver iodide and silver chloride crystals, even if emulsion peptizer did not interfere. When the silver chloride portion of the composite crystals is converted to a converted-halide silver halide crystal structure, the crystallographic orientation of the resulting crystal is controlled by the parent silver chloride crystal, although a substantial degree of internal dislocations is introduced. Thus the converted-halide silver halide crystals are also in an epitaxial relationship to the silver iodide host crystals.

A preferred technique for forming the basic composite crystals is to first form the host silver iodide crystals by conventional methods. To a reaction vessel containing the silver iodide crystals a chloride salt solution, e.g. in sodium or potassium chloride salt solution, and a silver ion containing feedstock, such as a silver nitrate solution, are separately added. The silver and chloride ion feedstocks can be of any conventional type employed in double jet silver chloride preparations. The necessary vehicle for emulsion formation is at least in part already in the reaction vessel dispersing the silver iodide crystals. Additional vehicle can be introduced along with either or both of the silver ion or chloride ion feedstocks or using a separate jet. The proportion of silver chloride in the final emulsion is determined by limiting the quantity of the silver and/or chloride ion introduced.

The techniques and parameters are well known in the art for favoring continued silver halide growth on an existing silver halide crystal, in this instance epitaxial deposition of silver chloride on the host silver iodide crystals, as compared with formation of new crystals. Substantially all of the silver iodide host crystals can be converted to composite silver halide crystals, with little, if any, separate silver chloride crystal formation occurring, by employing a double jet precipitation of silver chloride as described above and rapid introduction of silver and chloride ions. By employing precipitation conditions which favor nucleation, a mixture of composite silver halide crystals, silver iodide crystals and silver chloride crystals can be produced. Where the composite silver halide crystals are formed along with separate silver iodide and silver chloride crystals, conventional silver halide grain separation techniques can be employed to increase the proportion of the composite silver halide grains present. Alternatively, the emulsion can be employed directly as formed. While the composite silver halide grain preparation technique described above is preferred, other techniques are known to produce composite silver halide crystal structures and can be employed, if desired.

As disclosed in my copending application Ser. No. 770,242, filed Feb. 18, 1977, titled "Converted Halide Photographic Emulsions and Elements", after the formation of the composite epitaxial silver chloride and silver iodide emulsion, a soluble bromide salt can be added to convert at least a portion of the silver chloride crystal, which is the most soluble silver halide, to silver bromide. If desired, a soluble iodide salt can be added together with the bromide salt. Potassium bromide and potassium iodide are especially useful for this purpose. It is not essential to convert all of the silver chloride to silver bromide or silver bromoiodide. The useful converted-halide silver halide grains thus can include silver bromide, silver bromoiodide, silver chlorobromide or silver chlorobromoiodide. The preferred converted-halide silver halide grains contain at least 50 (preferably 80) mole percent chloride and less than 10 mole percent iodide, based on total halide present therein, but excluding the silver iodide crystals, whether separate or epitaxially related. The method of converting the silver chloride grains in the parent composite emulsion can be accomplished by any conventional technique for producing a converted-halide silver halide emulsion. Preferred techniques are those disclosed by Davey and Knott U.S. Pat. No. 2,592,250 and Evans U.S. Pat. No. 3,622,318, each here incorporated by reference.

In its simplest form the photographic element to be employed has a single color-forming layer unit coated on a conventional photographic support. The layer unit consists essentially of the uniform distribution of catalyst and the negative-working high iodide silver halide emulsion described above. Although in certain preferred embodiments dye-image-generating reducing agent is incorporated in the element, this is not required.

After imagewise exposure to actinic radiation, the photographic element can be caused to produce a dye image by developing exposed silver halide to release iodide ions. The released iodide ions poison the catalyst in an imagewise manner and also poison developing silver so that it cannot act as a catalyst. This is believed to occur by iodide ion adsorption of the surfaces of the catalyst particles in the developed areas of the element. This leaves a positive catalyst image formed by that portion of the uniform catalyst distribution which is not poisoned by iodide ion release during silver halide development. A redox dye image-forming reaction of a peroxide oxidizing agent and a dye-image-generating reducing agent can then occur selectively at the unpoisoned catalyst sites provided by the positive catalyst image.

In a simple, illustrative form of practicing my process a two-step procedure can be employed which is analogous to, but different from, conventional reversal processing. In the first step a conventional developer can be employed to develop the high iodide silver halide and concurrently imagewise poison the catalyst so that a positive catalyst image remains in the element. In one preferred form of practicing my process no dye-image-generating reducing agent is present in either the element or the developer during this step, thus no dye image can be formed. This is true even though the element is of the conventional incorporated color coupler type.

In the second step of this simple, illustrative form of practicing my process the photographic element containing the positive catalyst image is brought into contact with an amplifier or amplification bath—that is, a solution containing a peroxide oxidizing agent and a dye-image-generating reducing agent. The oxidizing and reducing agents are chosen so that they selectively react at the surface provided by the positive catalyst image.

Depending upon the choice of dye-image-generating reducing agents and the manipulative steps employed, the result can be either a positive or a negative dye image, and the dye image can be either a dye image retained in the element or a dye image transferred to a conventional dye receiver. For example, if the dye-image-generating reducing agent is a color-developing agent, upon redox reaction oxidized developing agent is imagewise produced which can react with color coupler, either present in the amplifier or incorporated in the element. The result is a positive dye image formed in the element. On the other hand, if a dye-developer dye-image-generating reducing agent is employed of the type conventionally employed in image transfer systems, imagewise oxidation of the dye-developer selectively immobilizes the dye-developer. This can result in either a positive dye image being retained in the element or a negative dye image being transferred to a receiver.

In the foregoing simple, illustrative form of practicing my process no dye-image-generating reducing agent is present in either the element or the developer employed for poisoning to produce a catalyst image, but this is not essential to the practice of my process. Since the amount of dye that is produced during the silver halide development step required for catalyst poisoning can be small as compared to the amount of dye formed by the redox dye image-forming reaction, in many applications this small amount of dye in background areas is not objectionable or is at least tolerable. For example, I can employ a color-developing agent in the step of imagewise poisoning the catalyst, and the amount of dye formed can be sufficiently small in the absence of a redox oxidizing agent to be acceptable. That is, the minimum dye density produced in background areas will not be noticeable or at least not objectionable. Alternatively by simply failing to have a coupler present during this step, no dye at all is formed, even though a color-developing agent is employed in the poisoning step.

In another illustrative form of practicing my process with a dye-image-generating reducing agent present during the poisoning step, I can incorporate in the element as a dye-image-generating reducing agent a redox dye-releaser (hereinafter also referred to as an RDR). Such compounds are immobile and are known to release mobile dye upon reaction with oxidized developing agents which are electron transfer agents. By performing the poisoning step using a silver halide developing agent which is either not an electron transfer agent or a poor electron transfer agent, little or no dye will be released during the poisoning step. But, even if a developing agent is employed which is an efficient electron transfer agent, the amount of dye released during the poisoning step can be small compared to the amount of dye released as a result of the redox dye image-forming reaction. Employing an incorporated RDR as a dye-image-generating reducing agent, a positive transferred dye image can be obtained using a dye image receiver and/or a negative retained dye image can be produced using a positive catalyst image. In certain forms, such as integral format image transfer systems, the transferred dye image can be employed exclusively to produce a viewable image. With simple photographic elements a separate dye image receiver can be associated with the element after the redox reaction to transfer a dye image. Alternatively, the element can be washed after withdrawal from the amplifier, washing away mobile released dye and leaving as a retained image in the element the unreacted immobile RDR.

In the foregoing discussion of my process I have described a two-step process employing a developer and an amplifier; however, my process can be practiced using a single processing solution. I have recognized that the developer employed in the catalyst poisoning step can, but need not, be identical in composition to the amplifier, except that it lacks the peroxide oxidizing agent. Where this is the difference in composition distinguishing the developer from the amplifier, I can first contact the photographic element with the developer to achieve catalyst poisoning and then, after a delay sufficient to allow for catalyst poisoning, introduce the peroxide oxidizing agent. In a simple form the peroxide oxidizing agent can be added as an aqueous solution after poisoning is complete or is nearing completion. I specifically contemplate having peroxide oxidizing agent associated with the developer or the element at the beginning of the poisoning step, but in a form which renders it initially unavailable to act as an oxidizing agent. For example, the peroxide oxidizing agent can be made initially unavailable by using conventional time delay techniques, such as using a timing layer to isolate the peroxide oxidizing agent initially (as is conventional in image transfer systems), time delay encapsulation techniques, by having the peroxide oxidizing agent split off in a time controlled manner from a chemical precursor, etc. Time delay introduction of the peroxide oxidizing agent is particularly attractive in integral format image transfer systems, since employing a single processing solution is particularly attractive for such applications. Single solution processing can be practical with all of the dye-image-generating reducing agents discussed above, since it is only required that the electron transfer agent or dye-image-generating reducing agent which reacts with the peroxide oxidizing agent be itself a silver halide developing agent.

In many photographic applications it is a distinct advantage to have available the capability of reversing the sense of the dye image produced. This I can readily achieve with the photographic elements I employ where the high iodide silver halide emulsion present in the color-forming layer unit is a composite silver chloride-silver iodide emulsion. The first step is to poison substantially uniformly the uniform catalyst distribution in the photographic element. Thereafter the exposed composite silver chloride-silver iodide crystals are developed so that the silver chloride is developed to silver while the silver iodide portion of the composite crystals remains substantially undeveloped. This avoids the release of iodide ion, and the silver image produced by development forms a negative catalyst image. The redox dye image-forming reaction can then be performed using a peroxide oxidizing agent and a dye-image-generating reducing agent according to any of the techniques described above. Silver chloride development can be combined with the redox dye image-forming step using a single processing solution. Further, it is not necessary to delay introduction of the peroxide oxidizing agent, since the uniform catalyst has already been uniformly poisoned.

A photographic element which is capable of recording electromagnetic radiation from at least three portions of the electromagnetic spectrum is particularly useful in the processes of the present invention. Typically, the element is capable of recording radiation from the red, green and blue portions of the visible spectrum and therefore provides means for forming a multicolor image. The element comprises a support having coated thereon at least three radiation-sensitive color-forming layer units each containing an incorporated coupler or initially immobile dye-image-generating reducing agent. Each layer unit has a silver halide emulsion containing at least 25 mole percent silver iodide that is sensitized to a different portion of the spectrum than the others. Each layer unit also has a substantially uniform distribution of catalyst. In order to insure image separation between the layers, it is desirable that the layers be separated by at least one interlayer which inhibits the migration of iodide ions. The interlayer can be comprised of a combination of catalyst and an oxidized developing agent scavenger, such as colloidal silver and dioctylhydroquinone. The interlayer is, of course, free of either incorporated coupler or dye-image-generating reducing agent. The catalyst adsorbs the iodide ions which would otherwise migrate between adjacent color-forming layer units. The dioctyl hydroquinone prevents migration of oxidized developing agent between adjacent color-forming units and also prevents migration out of the interlayer of any developing agent which enters into a redox reaction with the peroxide oxidizing agent within the interlayer. Since silver iodide has a solubility product constant several orders of magnitude lower than silver bromide and silver chloride, these latter silver halides can be employed as interlayer iodide ion scavengers. Cationic vinyl polymers re also known to be useful iodide ion scavengers. Such polymeric scavengers are disclosed, for example, at 141 *Research Disclosure* 14103, January 1976. The layer unit arrangements, interlayers, overlayers, subbing layers and additional addenda, if any, and other features of the photographic elements can be of any convenient conventional type.

As will be readily apparent to those skilled in photography, my process can be practiced employing a wide variety of well known materials incorporated in photographic elements and in processing solutions. Specific preferred features of my invention which are in and of themselves conventional in the art of photography are set forth below to elaborate further upon and illustrate my invention.

Where a color-developing agent is employed as a dye-image-generating reducing agent in the redox dye image-forming reaction, the useful elements preferably also contain at least one incorporated color coupler. The color couplers employed in combination with the color-developing agents include any compound which reacts with the oxidation products of a primary aromatic amino developing agent on photographic development to form an image dye and also any compound which provides useful image dye when reacted with oxidized primary aromatic amino developing agent such as by a coupler-release mechanism. These compounds have been variously termed "color couplers", "photographic color couplers", "dye release couplers", "dye-image-generating couplers", etc., by those skilled in the photographic arts. The photographic color couplers can be incorporated in the amplification bath more specifically described below, or in the emulsion layer or an adjacent layer of each color-forming layer unit forming the photographic element, e.g., as described and referred to in *Product Licensing Index,* Vol. 92, December 1971, page 110, paragraph XXII. When they are incorporated in the element, they preferably are nondiffusible in a hydrophilic colloid binder (e.g., gelatin). The couplers can form diffusible or, preferably, nondiffusible dyes. Typical preferred color couplers include phenolic, 5-pyrazolone and open-chain ketomethylene couplers. Specific cyan, magenta and yellow color couplers which can be employed in the practice of this invention are described by Graham et al. in U.S. Pat. No. 3,046,129 issued Jan. 24, 1962, column 15, line 45, through column 18, line 51, which disclosure is incorporated herein by reference. Such color couplers can be dispersed in any convenient manner, such as by using the solvents and the techniques described in U.S. Pat. Nos. 2,322,027 by Jelley et al. issued June 15, 1943, or 2,801,171 by Fierke et al. issued July 30, 1957. When coupler solvents are employed, the most useful weight ratios of color coupler to coupler solvent range from about 1:3 to 1:0.1. The useful couplers include Fischer-type incorporated couplers such as those described by Fischer in U.S. Pat. No. 1,055,155 issued March 4, 1913, and particularly nondiffusible Fischer-type couplers containing branched carbon chains, e.g., those referred to in Willems et al U.S. Pat No. 2,186,849. Particularly useful in the practice of this invention are the nondiffusible color couplers which form nondiffusible dyes.

In certain preferred embodiments, the couplers incorporated in the photographic elements to be processed are water-insoluble color couplers which are incorporated in a coupler solvent which is preferably a moderately polar solvent. Typical useful solvents include tri-o-cresyl phosphate, di-n-butyl phthalate, diethyl lauramide, 2,4di-tert-amylphenol, liquid dye stabilizers as described in an article entitled "Improved Photographic Dye Image Stabilizer-Solvent", *Product Licensing Index,* Vol. 82, pp. 26–29, March, 1971 and the like.

In certain highly preferred embodiments, the couplers are incorporated in the photographic elements by dispersing them in a water-miscible, low-boiling solvent having a boiling point of less than 175° C. and preferably less than 125° C., such as, for example, the esters formed by aliphatic alcohols and acetic or propionic acids, i.e., ethyl acetate, etc. Typical methods for incorporating the couplers in photographic elements by this technique and the appropriate solvents are disclosed in U.S. Pat. Nos. 2,949,360, column 2, by Julien; 2,801,170 by Vittum et al; and 2,801,171 by Fierke et al.

Color couplers can also be incorporated into the photographic elements that are useful in the practice of my invention by blending them into the hydrophilic colloid binder in the form of latexes, called "coupler-loaded" latexes. Coupler-loaded latexes are polymeric latexes into the particles of which has been blended the coupler(s). Coupler-loaded latexes can be prepared in accordance with the process of Chen, which is described in U.S. patent applications Ser. Nos. 778,182, filed May 8, 1975, refiled Feb. 23, 1978, as Ser. No. 880,684, and Ser. No. 778,184, filed May 8, 1975, refiled Feb. 27, 1978, as Ser. No. 882,282, the disclosures of which are incorporated by reference into the present application. Briefly, this process involves (1) the dissolution of the coupler into a water-miscible organic solvent, (2) blending into the resulting solution a selected latex, and (3) optionally removing the organic solvent, for example, by evaporation thereof.

It is realized that the density of the dye may vary with the developing agent combined with the respective coupler, and accordingly the quantity of coupler can be adjusted to provide the desired dye density. Preferably, each layer unit contains at least $1\times10^{-6}$ moles/dm$^2$ of color coupler when color couplers are employed.

Advantageously, the photographic color couplers utilized are selected so that they will give a good neutral dye image. Preferably, the cyan dye formed has its major visible light absorption between about 600 and 700 nm (that is, in the red third of the visible spectrum), the magenta dye has its major absorption between about 500 and 600 nm (that is, in the green third of the visible spectrum), and the yellow dye has its major absorption between about 400 and 500 nm (that is, in the blue third of the visible spectrum). Particularly useful elements comprise a support having coated thereon red-, green- and blue-sensitive silver halide emulsion layers containing, respectively, cyan, magenta and yellow dyeforming photographic color couplers, each layer having a substantially uniform distribution of catalyst.

Where an initially immobile dye-image-generating reducing agent is employed, it is initially present within the photographic element. Redox dye-releasers (RDR's) constitute a preferred class of initially immobile dye-image-generating reducing agents. Suitable redox dye-releaser containing photographic elements can be formed by substituting RDR's for the incorporated color couplers in the photographic elements described above. In a multilayer photographic element intended to form a multicolor image one or more RDR's capable of releasing a yellow dye are incorporated in the blue recording emulsion layer or in a separate processing solution permeable layer adjacent thereto at a coverage of from about 2.5 to 15 mg/dm$^2$, preferably 5 to 10 mg/dm$^2$. The layer adjacent the emulsion layer is typically a hydrophilic colloid layer, such as a gelatin layer. In a similar manner one or more RDR's are also associated with the green and red recording emulsion layers capable of releasing magenta and cyan dyes, respectively. Single color, single RDR-containing photographic elements are, of course, useful as well as multicolor elements.

Exemplary of specifically preferred RDR's are those of the sulfonamide type, which may be represented by the following general formula:

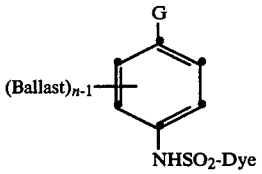

(I)

wherein:

(1) Dye is a dye or dye precursor moiety;

(2) Ballast is an organic ballasting radical of such molecular size and configuration (e.g., simple organic groups or polymeric groups) as to render the compound nondiffusible during development in an alkaline processing composition;

(3) G is OR or NHR$_1$ wherein R is hydrogen or a hydrolyzable moiety and R$_1$ is hydrogen or a substituted or unsubstituted alkyl group of 1 to 22 carbon atoms, such as methyl, ethyl, hydroxyethyl, propyl, butyl, secondary butyl, tert-butyl, cyclopropyl, 4-chlorobutyl, cyclobutyl, 4-nitroamyl, hexyl, cyclohexyl, octyl, decyl, octadecyl, docosyl, benzyl, phenethyl, etc., (when R$_1$ is an alkyl group of a greater than 6 carbon atoms, it can serve as a partial or sole Ballast group); and (4) n is a positive integer of 1 to 2 and is 2 when G is OR or when R$_1$ is hydrogen or an alkyl group of less than 8 carbon atoms.

In addition to Ballast, the benzene nucleus in the above formula may have groups or atoms attached thereto such as the halogens, alkyl, aryl, alkoxy, aryloxy, nitro, amino, alkylamino, arylamino, amido, cyano, alkylmercapto, keto, carboalkoxy, heterocyclic groups, etc. In addition, such groups may combine together with the carbon atoms to which they are attached on the ring to form another ring which may be saturated or unsaturated including a carbocyclic ring, a heterocyclic ring, etc. Preferably an aromatic ring is directly fused to the benzene nucleus which would form, for example, a naphthol. Such a p-sulfonamidonaphthol is considered to be a species of a p-sulfonamidophenol and thus included within the definition. The same is true for p-sulfonamidoanilines of the invention.

Exemplary hydroquinone-type RDR's which can be used according to this invention are represented by the following formula:

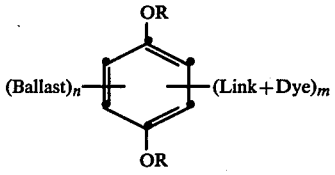

(II)

wherein:

(1) each R represents hydrogen or a hydrolyzable moiety;

(2) Ballast is a photographically inert organic ballasting radical of such molecular size and configuration as to render the alkali-cleavable compound nondiffusible during development in an alkaline processing composition;

(3) Dye is a dye or dye precursor;

(4) Link is a S, O, or SO$_2$ linking group;

(5) n is an integer of 1 to 3; and (6) m is an integer of 1 to 3.

The nature of the ballast group (Ballast) in the formula for the compounds described above is not critical as long as it confers nondiffusibility to the compounds. Typical ballast groups include long-chain alkyl radicals linked directly or indirectly to the compound as well as aromatic radicals of the benzene and naphthalene series indirectly attached or fused directly to the benzene nucleus, etc. Useful ballast groups generally have at least 8 carbon atoms such as a substituted or unsubstituted alkyl group of 8 to 22 carbon atoms, an amide radical having 8 to 30 carbon atoms, a keto radical having 8 to 30 carbon atoms, etc.

As previously mentioned, Dye in the above formula represents a dye or dye precursor moiety. Such moieties are well known to those skilled in the art and include dyes such as azo, azomethine, azopyrazolone, indoaniline, indophenol, anthraquinone, triarylmethane, alizarin, metal complexed dyes, etc., and dye precursors such as a leuco dye, a "shifted" dye which shifts hypsochromically or bathochromically when subjected to a different environment such as a change in pH, reaction with a material to form a complex, etc. Dye could also be a coupler moiety such as a phenol, naphthol, indazolone, open-chain acetanilide, pivalylacetanilide, malonamide, malonanilide, cyanoacetyl, coumarone, pyrazolone, compounds described in U.S. Pat. No. 2,765,142, etc. These compounds may contain a solubilizing group if desired. Examples of such dye groups include the following:

| YELLOW DYE GROUPS |
|---|
| YDG-1 4-Hydroxy azophenylphenylene |

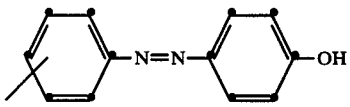

-continued

YELLOW DYE GROUPS

YDG-2 3-Methyl-4-hydroxyazophenylphenylene

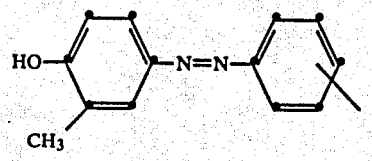

YDG-3

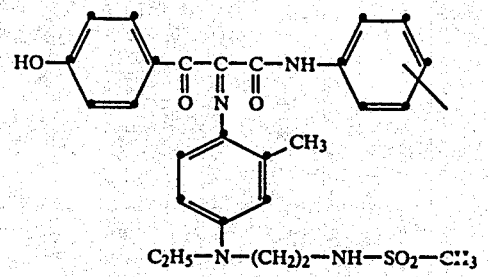

YDG-4 p-Sulfhydrylazophenylphenylene

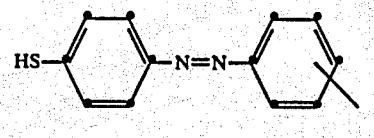

YDG-5

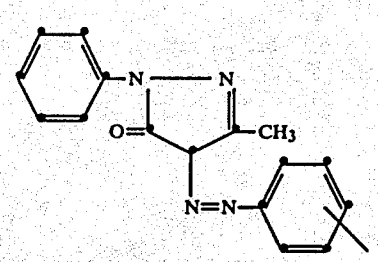

YDG-6

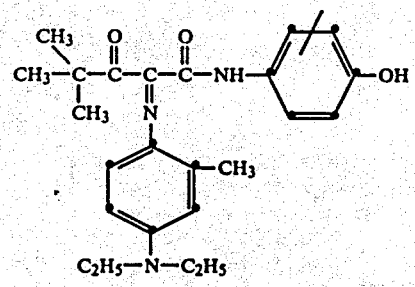

YDG-7

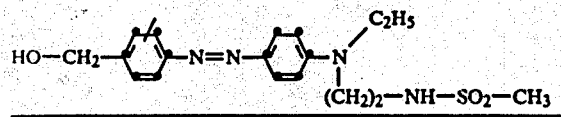

MAGENTA DYE GROUPS

MDG-1

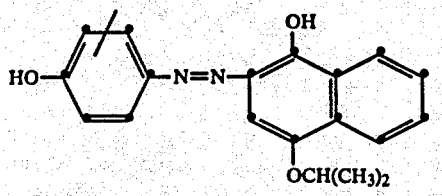

-continued

MAGENTA DYE GROUPS

MDG-2

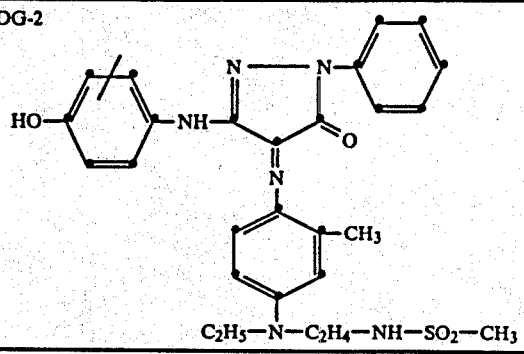

CYAN DYE GROUPS

COG-1

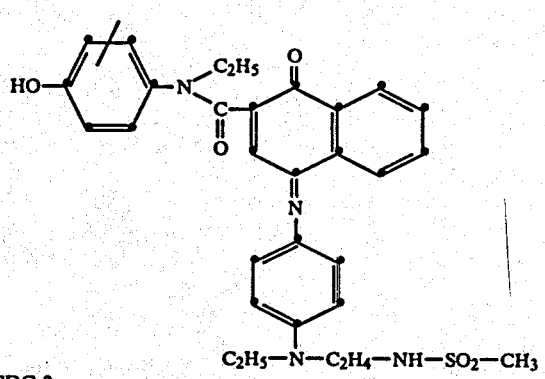

CDG-2

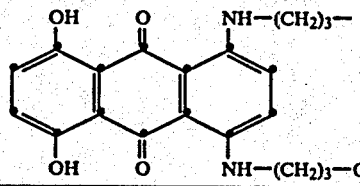

When dye precursor moieties are employed in the RDR's instead of dyes, they are converted to dyes by means well known to those skilled in the art, e.g., oxidation, either in the photosensitive element, in a processing composition or in a dye image-receiving layer to form a visible dye. Such techniques are disclosed, for example, in British Pat. Nos. 1,157,501; 1,157,502; 1,157,503; 1,157,504; 1,157,506; 1,157,507; 1,157,508; 1,157,509; 1,157,510; and U.S. Pat. No. 2,774,668; 2,698,798; 2,698,244; 2,661,293; 2,559,643; etc.

Examplary redox dye-releasers and their synthesis and incorporation into photographic elements are, for example, described in Whitmore et al Canadian Pat. No. 602,607 (issued Aug. 2, 1960); Fleckenstein Belgian Pat. No. 788,268 (issued Feb. 28, 1973); Fleckenstein et al. published U.S. patent application Ser. No. B351,673 (published Jan. 28, 1973); *Research Disclosure* 15157 published Nov. 11, 1976; Gompf U.S. Pat. No. 3,698,897; Becker et al U.S. Pat. No. 3,728,113; Anderson et al. U.S. Pat. No. 3,725,062; and U.S. Pat. Nos. 3,443,939; 3,443,940; 3,443,941; 3,390,380 and the like; all of which are here incorporated by reference. In a preferred form the RDR's are incorporated in the photographic elements by the loading procedures of Chen U.S. Ser. Nos. 778,182 and 778,184, cited above.

The development of the high iodide silver halide emulsion layer to release iodide ions for poisoning the uniform catalyst can be accomplished by conventional silver halide development techniques, such as disclosed in my copending applications Ser. Nos. 770,241 and 770,242, cited above. I prefer to employ vigorous developing conditions and developing agents, such as hydroquinone, catechol, halohydroquinones, mixtures of p-N-methylaminophenol sulfate (Elon) and hydroquinone, or 1-phenyl-3-pyrazolidinone (Phenidone). Development of the composite crystals to release iodide ions can also be obtained using color-developing agents, e.g. aminophenols and p-phenylenediamines, in combination with color couplers.

The photographic developers employed in the catalyst poisoning step of my process can include, in addition to conventional developing agents, other conventional components. The developers are typically aqueous solutions, although organic solvents, such as diethylene glycol, can also be included to facilitate the solvency of organic components. Since the activity of developing agents is frequently pH-dependent, it is contemplated to include activators for the developing agent to adjust the pH. Activators typically included in the developer are sodium hydroxide, borax, sodium metaborate, sodium carbonate and mixtures thereof. Sufficient activator is typically included in the developer to maintain an alkaline developer solution, usually at a pH above 8.0 and, most commonly, above 10.0 to a pH of about 14. To reduce aerial oxidation of the developing agent and to avoid the formation of colored reaction products, it is commonplace to include in the developer a preservative, such as sodium sulfite. It is also common practice in include in the developer a restrainer, such as potassium bromide, to restrain nonimage development of the silver halide with the consequent production of development fog. To reduce gelatin swelling during development, compounds such as sodium sulfate may be incorporated into the developer. Also compounds such as sodium thiocyanate may be present to reduce granularity. When the silver halide crystals being developed form an internal latent image, a silver halide solvent can be incorporated, as is conventional in "internal" developers. Generally, any photographic developer for silver halide photographic emulsions which is substantially free of a catalyst poison can be employed in the practice of my invention. Specific illustrative photographic developers and instructions for their use are disclosed in the *Handbook of Chemistry and Physics*, 36th Edition, under the title "Photographic Formulae" at page 3001 et seq. and in *Processing Chemicals and Formulas*, 6th Edition, published by Eastman Kodak Company (1963), the disclosures of which are here incorporated by reference. It is, of course, possible to incorporate the developing agent as well as other developer solution addenda noted above directly in the photographic element so that they are released into the developer solution during the silver halide development step, as is well understood by those skilled in the art.

The amplifier or amplification bath can differ from the developer solely by the inclusion of a peroxide oxidizing agent. During the dye image-forming step both a peroxide oxidizing agent and at least one dye-image-generating reducing agent can be viewed as being in contact on the surface of the catalyst in the element. In a preferred form the amplification bath can take the form of conventional peroxide oxidizing agent containing redox amplification baths of the type disclosed in U.S. Pat. Nos. 3,674,490 and 3,776,730. The bath can also take the form of that disclosed in British Pat. No. 1,329,444 or "Image Amplification System", Item No. 11660 of *Research Disclosure*. The amplification bath in a prepared form can also correspond to that disclosed in Bissonette, U.S. Ser. No. 730,912, cited above.

The peroxide oxidizing agents employed can be chosen from among conventional peroxide oxidizing agents which are known to require the presence of a catalyst to oxidize an electron transfer agent—that is, are essentially inert to oxidation-reduction in the absence of catalyst. More specifically, in the absence of the catalyst the oxidant and the reductant can be described as being in a state where they are substantially kinetically stable; i.e., the kinetic reaction is so slow (or practically nonexistent) as to be not noticeable in the process. Preferably, the peroxide oxidizing agent and the dye-image-generating reducing agent are so chosen that, when test samples thereof are each dissolved at a 0.01 molar concentration in an inert solvent at 20° C., essentially no redox reaction occurs for at least 10 minutes, most preferably for several hours. Peroxide oxidizing agents of this type include water-soluble compounds containing a peroxy group, such as inorganic peroxide compounds or salts of peracids. For example, perborates, percarbonates or persilicates and, particularly, hydrogen peroxide, can be employed as peroxide oxidizing agents herein, as well as organic peroxide compounds such as benzoyl peroxide, percarbamide and addition compounds of hydrogen peroxide and aliphatic acid amides, polyalcohols, amines, acyl-substituted hydrazines, etc. I prefer to employ hydrogen peroxide, since it is highly active and easily handled in the form of aqueous solutions. Peroxide oxidizing agent concentrations of from 0.001 mole to 1.0 mole per liter of amplification bath are preferred.

In one form, the dye-image-generating reducing agent is a compound which forms a highly colored reaction product upon oxidation or which upon oxidation is capable of reacting with another compound, such as a color coupler, to form a highly colored reaction product. Where the dye-image-generating reducing agent forms a colored reaction product directly upon oxidation, it can take the form of a dye precursor such as, for example, a leuco dye or vat dye that becomes highly colored upon oxidation.

Where the dye-image-generating reducing agent is oxidized to form a highly colored reaction product with another compound, such as a color coupler, the dye-image-generating reducing agent is preferably employed in the form of a color-developing agent. The coupler to be employed in combination with the color developing agent can be present in the redox amplification bath in the same concentrations normally employed in color developer compositions. In a preferred form, however, the coupler is incorporated in the photographic element to be processed.

Instead of producing a colored reaction product upon oxidation, the dye-image-generating reducing agent can be of a type which is initially colored, but which can be used to provide an imagewise distribution of image dye by alteration of its mobility upon oxidation. Dye-image-generating reducing agents of this type include dye developers of the type disclosed, for example, in Rogers U.S. Pat. Nos. 2,774,668 (issued Dec. 18, 1956) and 2,983,606 (issued May 9, 1961), here incorporated by reference. These compounds are silver halide developing agents which incorporate a dye moiety. Upon oxidation by the peroxide oxidizing agent directly or acting through an electron transfer agent (such as described above), the dye developer alters its mobility to allow a dye image to be produced. Typically, the dye developer goes from an initially mobile to an immobile form upon oxidation in the redox amplification bath.

The amount of mobile dye-image-generating reducing agent incorporated within the amplification bath can be varied over a wide range corresponding to the concentrations in conventional photographic developer baths. The amount of color-developing agent used in the amplification bath is preferably from about 1 to 20 and, most preferably, from about 2 to 10 grams per liter, although both higher and lower concentrations can be employed.

In one specific preferred embodiment of my process color-forming coupler is incorporated in the photographic element to be processed, development to poison the catalyst is conducted with a black-and-white developing agent to avoid dye formation and the amplification bath contains a color-developing agent as a dye-image-generating reducing agent.

In another specific preferred embodiment of my process RDR is incorporated in the photographic element to be processed, development to poison the catalyst is conducted with a developing agent which is not an electron transfer agent and the amplification bath contains an electron transfer agent.

The preferred electron transfer agents to be employed with the RDR's are pyrazolidinone developing agents, such as 1-phenyl-3-pyrazolidinone (Phenidone, trademark), 1-phenyl-4,4-dimethyl-3-pyrazolidinone (Dimezone, trademark) and 4-hydroxymethyl-4-methyl-1-phenyl-3-pyrazolidinone. Exemplary of developing agents which also are well suited to use as electron transfer agents are aminophenol developing agents and p-phenylenediamine developing agents, particularly N,N,N',N'-tetraalkyl-p-phenylenediamine developing agents (e.g., N,N,N',N'-tetramethyl-p-phenylenediamine). The concentration of the electron transfer agent in the amplifier is preferably about 0.05 to 20 and, most preferably, from about 0.5 to 10 grams per liter, although both higher and lower concentrations can be employed. Such electron transfer agents are more specifically disclosed in the patents cited above disclosing RDR's. Amplification baths useful in the practice of my process are more specifically disclosed in Bissonette U.S. Ser. Nos. 821,871 and 821,872, both filed Aug. 4, 1977, now abandoned.

The preferred developing agents in the silver halide development step where an RDR is present in the photographic element are not electron transfer agents under the conditions of use. They include ascorbic acid and certain derivatives of pyrimidine such as those disclosed by Wyland and Farley in U.S. Pat. No. 3,672,891, issued on June 27, 1972, which is here incorporated by reference. Particularly preferred are 5-amino derivatives of pyrimidine and 5-hydroxy derivatives of pyrimidine, especially 2-methyl-4-amino-5-hydroxypyrimidine-6-one. Development of silver halide under conditions which does not result in chemical reaction with RDR present in a photographic element is more specifically and fully described in Faul and Franchino U.S. Pat. No. 3,998,637, issued Dec. 21, 1976, the disclosure of which is here incorporated by reference.

The term "nondiffusible" used herein as applied by dye-image-generating reducing agents, couplers, dyes and their reaction products has the meaning commonly applied to the term in color photography and denotes materials which for all practical purposes do not migrate or wander through photographic hydrophilic colloid layers, such as gelatin, during processing in aqueous alkaline solutions. The same meaning is attached to the term "immobile". The terms "diffusible" and "mobile" have meanings converse to the above.

Since the dye-image-generating reducing agents employed in the practice of my process have heretofore been employed in the art in silver halide photographic elements and developer solutions, best results can be obtained by maintaining the amplification bath within the alkaline pH ranges heretofore employed in developing photographic silver halide emulsions to form dye images using these dye-image-generating reducing agents. Preferred alkalinity for the amplification bath is at least 8, most preferably from 10 to about 14. The amplification bath is typically maintained alkaline using activators of the type described above in connection with the developing step of my process.

Other addenda known to facilitate image-dye formation in alkaline photographic developer solutions with specific dye-image-generating reducing agents can also be included in the amplification bath. For example, where incorporated color couplers are employed, it may be desirable to incorporate an aromatic solvent such as benzyl alcohol to facilitate coupling. Where lower pH alkaline amplification baths are being employed in combination with RDR-containing photographic elements, the mobility of the released dye can be enhanced by incorporating amino acids or combinations of amines and aliphatic carboxylic acids. Exemplary useful compounds include ω-amino acids, such as 2-aminoacetic acid, 4-aminobutyric acid, 6-aminohexanoic acid, 11-aminoundecanoic acid and 12-aminododecanoic acid. Such released dye solubilizers can be present in the amplification bath in concentrations of from about 0.1 to 60 grams per liter, preferably from about 1 to 20 grams per liter.

In the foregoing discussion I have omitted mention of a number of optional, ancillary processing steps of a conventional nature. For example, it is known that silver halide emulsion layers can be treated in stop, fix, bleach, blix and/or rinse baths in conjunction with processing, if desired. Such ancillary processing is common in photographic processing where the elements are immersed in processing baths, but is usually not employed in integral format image transfer processing. In integral format image transfer processing it is common, although not always essential, to stop development by incorporating in the element an acid layer separated from the emulsion layers by a timing layer, so that the pH of the processing solution is caused to drop below effective development levels after the desired degree of processing has been achieved. In image transfer applications mobile dye is frequently mordanted at the dye-image receiver at mordanting sites provided by the quaternized nitrogen atoms of a mordant polymer. Where it is intended to employ retained immobile redox dye-releaser for imaging and it is desired that the hue of the retained dye match that which would be obtained by mordanting, the photographic element can be washed with an aqueous onium solution. Such solutions are disclosed, for example, in Bush U.S. Pat. No. 3,271,147 and Whitmore U.S. Pat. No. 3,271,448, both issued Sept. 6, 1966 and Bush et al. U.S. Pat. No. 3,791,827, issued Feb. 12, 1974.

In addition to the capability of directly forming a positive catalytic image by the single step of developing a composite silver chloride-silver iodide solution, a negative catalytic image can be formed in the same element in two steps. First, the uniform distribution of catalyst is poisoned. Second, the silver chloride portion of the silver halide emulsion is selectively developed. The silver that results from this second step forms a negative catalytic image which can be used to catalyze a dye image-forming redox reaction.

The uniform distribution of catalyst can be poisoned by simply immersing the element in a bath containing the poison, such as a bath containing mercaptan poisoning agent.

Mercaptans are quite useful in poisoning the catalyst. Because of their affinity for the catalyst surface mercaptans can be used in concentrations which, on a molar basis, is about $1\times10^5$ to 10 millimoles per liter. Generally any mercaptan known to be useful in silver halide photographic elements or processing solutions can be employed. Phenylmercaptotetrazoles and lower alkyl ($C_{1-5}$) mercaptotetrazoles are preferred. A particularly preferred mercaptan poisoning agent is p-acetoamidophenylmercaptotetrazole.

Conventional silver halide antifoggants of various types which are free of mercapto groups can also be employed as catalyst poisons. These antifoggants are useful catalyst poisons within the conventional antifoggant concentrations above 1 gram per liter. Although antifoggants exhibit differing optimum concentrations, useful levels of catalyst poisoning can be obtained in the range of from about 1 gram per liter to 30 grams per liter, preferably from about 2 to 10 grams per liter where the antifoggant neither has nor is capable of forming a mercapto substituent.

Useful exemplary mercaptans and antifoggants are listed in commonly assigned copending application Ser. No. 730,912, cited above, here incorporated by reference.

The composite silver chloride-silver iodide emulsion can be developed without the release of iodide ions by suitable adjustment of developing conditions. For example, where the composite crystals are used, iodide ion release can be controlled by preferential development of the silver chloride portion of the crystal. The silver chloride can be preferentially development conditions and the development can be terminated before significant silver iodide development has commenced. Selective development of silver chloride in a composite silver chloride-silver iodide emulsion is more specifically disclosed in my copending application Ser. No. 770,241, here incorporated by reference to illustrate this teaching. Once the formation of the negative catalyst image is completed, the step of forming the dye image can be accomplished identically as when a positive catalyst image is present in the element. It is generally preferred that dye image formation and selective development of the silver chloride portion of the composite crystals occur in the same processing solution. Whereas high iodide silver halide grains other than or in addition to composite silver chloride-silver iodide grains can be developed to form a positive catalyst image, in forming a negative catalyst image no other high-iodide crystals are present in the emulsion layer being developed which are capable of releasing iodide ions under the conditions of silver chloride development. Preferably all high iodide silver halide crystals present are composite silver chloride-silver iodide crystals.

*Product Licensing Index* and *Research Disclosure*, both cited above, are published by and available from Industrial Opportunities Ltd., Homewell, Havant Hampshire, P09 1EF, United Kingdom.

The following examples are intended to further illustrate my invention:

EXAMPLE 1

Preparation of Yellow Colloidal Silver

To 100 ml of a 1% aqueous solution of gelatin containing 35 mg of $NaBH_4$ was added 25 ml of an aqueous solution of $AgNO_3$ (98.4 mg). After standing for 1 hour, 6 drops of acetone were added, and the mixture was allowed to stand for an additional hour. After passing through an ion exchange resin, the resulting colloidal silver solution was found to contain 0.45 mg Ag/ml.

The Silver Iodide Emulsion

A silver iodide emulsion was prepared having a pAg of 8.1 and a pH of 5.91. The emulsion also contained, per mole of silver iodide, 10 mg of $KAuCl_4$ and 40 mg of thiosulfate. This emulsion was sensitized by heating for 120 minutes at 60° C. before coating.

A coating was made on a poly(ethylene terephthalate) photographic film support having the listed components at the indicated coverages (mg/m$^2$). The coating composition also contained a spreading agent and a gelatin hardener.

| | |
|---|---|
| AgI | 21 |
| Colloidal Silver | 5 |
| Cyan dye-forming coupler | 1076 |
| Gelatin | 3583 |

The cyan dye-forming coupler was 2-[α-(2,4-di-tert-amylphenoxy)butyramino]-4,6-dichloro-5-methylphenol (See U.S. Pat. No. 2,423,730).

After a sensitometric exposure for one-half second at a color temperature of 3000° K., sample of the above-described element was treated for one minute at 20° C. in a silver halide developer and then for three minutes in an amplifier and finally in a 1% solution of acetic acid for one minute. A positive cyan dye image resulted. The dye image had a contrast of 1.39 and a minimum density (Dmin) of 0.24 and a maximum density (Dmax) of 1.72 as measured through a filter pack consisting of 2 Kodak Wratten 92 filters, 1 Kodak Wratten 29 filter and a Corning 9780 1.5 mm filter. For the purpose of comparison with subsequent examples, this element was assigned a relative speed of 1.

The silver halide developer had the following composition

| Silver Halide developer | | |
|---|---|---|
| p-N-Methylaminophenol sulfate | 7 | g |
| Ascorbic acid | 5 | g |
| KCl | 0.4 | g |
| $Na_2HPO_4$ | 12.78 | g |
| Water to make | 1 | liter |

The amplifier had the following composition:

| Amplifier | | |
|---|---|---|
| $K_2CO_3$ | 10 | g |
| $K_2SO_3$ | 2 | g |

-continued

| Amplifier | |
|---|---|
| Color developing agent | 5 g |
| Water to make | 1 liter |
| 30% aqueous solution of $H_2O_2$ (added just prior to use) | 10 ml |

The color developing agent was 4-amino-N-ethyl-N-(2-methyloxyethyl)-m-toluidine-di-p-toluene sulfonic acid (see U.S. Pat. No. 3,816,134).

EXAMPLES 2 and 3

Elements were prepared as in Example 1, except that for Example 2 the element contained 21 mg/m$^2$ of a composite AgCl/AgI crystal emulsion (0.26 micron AgI crystals, 20 mole percent AgCl based on a total silver halide in the composite crystals) and 2.9 mg/m$^2$ of yellow colloidal silver. The element for Example 3 was the same as the element for Example 2, except that the composite silver halide was chemically sensitized with aurous sulfide.

Both elements were exposed for one tenth of a second at a color temperature of 3000° K. and then developed at 20° C. by immersing in a solution which was the same as the amplifier of Example 1, except that no $H_2O_2$ was present. After development for two minutes, 10 ml/liter of a 30% aqueous solution of $H_2O_2$ was added to the solution and the elements were processed in the resulting amplifier solution for an additional two minutes. The elements were then placed in a 1% aqueous solution of acetic acid for one minute. As in Example 1, a positive cyan dye image resulted having the following characteristics. (The "Relative Speed" is referenced to the speed of the element in Example 1, which was assigned a relative speed of 1.)

| | Dmin | Dmax | Contrast | Relative Speed |
|---|---|---|---|---|
| Example 2 | 0.17 | 3.74 | 4.9 | 300 |
| Example 3 | 0.18 | 3.56 | 4.7 | 2400 |

EXAMPLE 4

Samples of the elements of both Example 2 and 3 were employed to produce negative images in the following manner: After exposure for one-tenth second as in Examples 2 and 3 the elements were soaked for 2 minutes in an aqueous solution containing 100 mg/l of p-acetamidophenylmercaptotetrazole. Following this treatment, a negative cyan dye image resulted by treating the elements in the amplifier bath of Example 1 for 1 minute. Both images had a Dmin of about 0.32, a Dmax of about 1.3 and a contrast of about 0.65.

EXAMPLES 5–8

Two coatings were prepared by coating the listed components at the indicated coverages, in mg/m$^2$, on a photographic support.

| | Comparative Example 5 | Example 6 | Example 7 | Comparative Example 8 |
|---|---|---|---|---|
| AgCl/AgI composite crystals | 21 | 21 | 21 | 0 |
| Yellow colloidal silver | 0 | 11 | 21 | 21 |
| Magneta RDR | 650 | 650 | 650 | 650 |
| Gelatin | 2600 | 2600 | 2600 | 2600 |

The magenta RDR was of the following general structure:

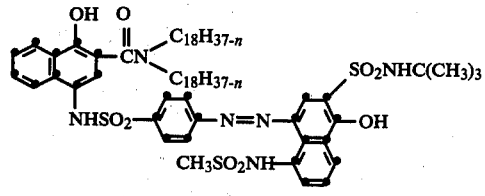

After exposure as in Example 1, each element was developed for 30 seconds, then amplified for 1 minute and then stopped, washed, bleached, fixed, washed and dried. The developer had the following composition:

| Silver Halide Developer | |
|---|---|
| Piperidinohexose reductone | 1 g |
| $K_2CO_3$ | 20 g |
| $K_2SO_3$ | 8 g |
| Water to make | 1 liter |

The amplifier had the following composition.

| Amplifier | |
|---|---|
| 4-hydroxymethyl-4-methyl-1-phenyl-3-pyrazolidone | 1 g |
| 11-aminoundecanoic acid | 2 g |
| $Na_3PO_4 \cdot 12\ H_2O$ | 40 g |
| Water to make | 1 liter |
| 30% aqueous solution of $H_2O_2$ | 10 ml |

The elements of both Examples 6 and 7 retained a negative magenta image, indicating that a positive dye image had been released. The element of Example 6 showed about two steps more speed than the element of Example 7. The control elements of Comparative Examples 5 and 8 did not produce dye images.

EXAMPLES 9–12

Four coatings were prepared by coating the listed components at the indicated coverages, in mg/m$^2$, on a photographic support:

| | | |
|---|---|---|
| AgCl/AgI composite crystals | | 3.54 |
| Cyan coupler (as in Example 1) | | 667 |
| Gelatin | | 2701 |
| | Catalyst | |
| Example 9 | Yellow colloidal silver | 1.21 |
| Example 10 | Palladium | 0.603 |
| Example 11 | Grey colloidal silver | 0.807 |
| Example 12 | Fogged AgCl | 0.516 |

The elements were exposed and processed as in Example 1. Each element gave a positive cyan dye image.

EXAMPLE 13

A photographic element capable of recording images from separate portions of the electromagnetic spectrum was prepared. The element can be schematically represented as follows: (coverages of the components are indicated in mg/m$^2$).

| |
|---|
| gelatin (1270)/cyan coupler as in Example 1 (334)/AgCl/AgI composite crystals (1.60)/yellow colloidal silver (0.89) |
| gelatin (1528)/scavenger for oxidized color developer (291)/ yellow filter dye (441)/as scavenger iodide ion, yellow colloidal silver (1.87) |
| gelatin (1453)/green sensitized AgCl/AgI composite crystals (1.62)/magenta coupler (398)/yellow colloidal silver (0.90) |
| paper support |

The scavenger for oxidized color developer was 2,5ditertoctylhydroquinone. The magenta coupler was a 5-pyrazolone coupler (coupler No. 11 in U.S. Pat. No. 3,519,429). Each layer also contained the coating aid p-tert-octylphenoxy polyethoxy ethanol.

The element was exposed on a wedge spectrograph and then developed and amplified as described in Examples 2 and 3. A positive cyan dye image was observed in the blue portion of the spectrograph and a positive magenta image was observed in the green portion.

The invention has been described in detail with particular reference to preferred embodiments thereof, but it will be understood that variations and modifications can be effected within the spirit and scope of the invention.

What is claimed is:

1. A method of forming a dye image employing an imagewise exposed photographic element comprising:
   (i) a support and, coated thereon,
   (ii) at least one radiation-sensitive color-forming layer unit, said layer unit including
      (a) a substantially uniform distribution of a catalyst capable of catalyzing a redox reaction between a peroxide oxidizing agent and a dye-image-generating reducing agent and
      (b) radiation sensitive, negative-working silver halide emulsion containing at least 25 mole percent silver iodide based on the total silver halide, said method comprising the steps of
         (1) imagewise poisoning said catalyst with iodide ion by developing said silver iodide containing silver halide emulsion so as to imagewise release said iodide ion thereby forming a positive catalytic image; and
         (2) thereafter catalyzing with said positive catalytic image, a redox reaction between a peroxide oxidizing agent and a dye-image-generating reducing agent wherein said oxidizing agent and said reducing agent are chosen so that they are essentially inert to oxidation-reduction in the absence of a catalyst.

2. The method according to claim 1 wherein said catalyst is colloidal silver.

3. The method according to claim 1 wherein said silver halide emulsion is comprised of composite silver halide crystals consisting essentially of
   multifaceted, radiation-receptive silver iodide crystals and
   silver chloride crystals forming epitaxial junctions with the silver iodide crystals.

4. The method according to claim 1 where said silver halide emulsion is comprised of composite silver halide crystals consisting essentially of
   multifaceted, radiation-receptive silver iodide crystals having a minimum mean diameter of at least 0.1 micron,
   silver chloride crystals forming epitaxial junctions with the silver iodide crystals, and
   at least half of the facets of thhe silver iodide crystals being substantially free of epitaxial silver chloride.

5. A method according to claim 1 wherein said radiation-sensitive color-forming layer unit contains a color coupler.

6. A method according to claim 5 wherein said dye-image-generating reducing agent is a color-developing agent.

7. A method according to claim 5 wherein said photographic element is comprised of three color-forming layer units, a first of which contains a silver halide emulsion sensitized to the red third of the visible spectrum and a cyan dye-forming coupler, a second of which contains a silver halide emulsion sensitized to the green third of the visible spectrum and a magenta dye-forming coupler and a third of which contains a silver halide and a yellow dye-forming coupler, wherein each of said color-forming layer units contains a substantially uniform distribution of catalyst.

8. A method according to claim 1 wherein said color-forming layer unit contains a redox dye-releaser as the dye-image-generating reducing agent.

9. A method according to claim 1 wherein said radiation sensitive color-forming layer unit contains a color coupler and wherein said amplification step comprises immersing said element in a solution comprising a peroxide oxidizing agent and a color-developing agent.

10. A method according to claim 1 wherein said radiation sensitive color-forming layer unit contains a redox dye-releaser and wherein said amplification step comprises contacting said element with a composition comprising a peroxide oxidizing agent and an electron transfer agent.

11. A method of forming a dye image employing an imagewise exposed photographic element comprising
   (i) a support and, coated thereon,
   (ii) at least one radiation-sensitive color-forming layer unit, said layer unit including
      (a) substantially uniform distribution of a catalyst capable of catalyzing a redox reaction between a peroxide oxidizing agent and a dye-image-generating reducing agent and
      (b) a radiation-sensitive, negative-working silver halide emulsion containing at least 25 mole percent iodide based on the total silver halide which is capable of being developed without the release of iodide ion containing composite silver halide crystals consisting essentially of multifaceted, radiation receptive silver iodide crystals and silver chloride crystals forming epitaxial junctions with the silver iodide crystals, said method comprising the steps of:
         (1) poisoning said catalyst,
         (2) selectively developing said silver chloride crystals without releasing iodide ion, thereby forming a negative catalytic silver image and
         (3) catalyzing with said negative catalytic silver image, a redox reaction between a peroxide oxidizing agent and a dye-image-generating reducing agent wherein said oxidizing agent and said reducing agent are chosen so that they are essentially inert to oxidation reduction in the absence of a catalyst.

12. The method according to claim 11 wherein said catalyst is colloidal silver.

13. The method according to claim 11 wherein said silver halide emulsion contains composite silver halide crystals consisting essentially of multifaceted, radiation receptive silver iodide crystals having a minimum mean diameter of at least 0.1 micron, silver chloride crystals forming epitaxial junctions with the silver iodide crystals, and at least half of the facets of the silver iodide crystals being substantially free of epitaxial silver chloride.

14. A method according to claim 11 wherein said poisoning step comprises immersing said element in a solution containing a mercaptan poisoning agent.

15. A method according to claim 14 wherein said mercaptan poisoning agent is a mercaptotetrazole.

16. A method according to claim 11 wherein said radiation sensitive color-forming layer unit contains a color coupler and said developing step and said amplification step comprise immersing said element in a solution containing a color-developing agent and a peroxide oxidizing agent.

17. A method of forming a dye image employing an imagewise exposed photographic element comprising (i) a support and, coated thereon, (ii) at least one radiation-sensitive color-forming layer unit, said layer unit including (a) a substantially uniform distribution of a catalyst capable of catalyzing a redox reaction between a peroxide oxidizing agent and a dye-image-generating reducing agent and (b) a radiation-sensitive, negative-working silver halide emulsion containing at least 25 mole percent silver iodide based on the total silver halide, said method comprising contacting the layer unit with an aqueous alkaline processing solution containing a silver halide developing agent to develop the silver iodide containing silver halide emulsion and thereby release iodide ions to poison the catalyst imagewise and produce a positive catalyst image, at least one of the color-forming layer unit and the aqueous alkaline processing solution containing a dye-image-generating reducing agent, and after the positive catalyst image has been formed, introducing a peroxide oxidizing agent into the aqueous alkaline processing solution to initiate a redox reaction between the peroxide oxidizing agent and the dye-image-generating reducing agent, said oxidizing agent and said reducing agent being chosen so that they are essentially inert to oxidation-reduction in the absence of a catalyst, so that oxidized dye-image-generating reducing agent is produced in an image pattern corresponding to the positive catalyst image, and producing a visible dye image from the imagewise oxidized dye-image-generating reducing agent.

18. A method according to claim 17 wherein the dye-image-generating reducing agent is a color-developing agent and the oxidized color-developing agent produces a dye image by reacting with a color-forming coupler.

19. A method according to claim 17 wherein the dye-image-generating reducing agent is a redox dye-releaser and a dye image is produced by transferring mobile dye released by the oxidized redox dye-releaser from the color-forming layer unit.

* * * * *